US005775936A

United States Patent [19]

Tsuji

[11] Patent Number: 5,775,936

[45] Date of Patent: Jul. 7, 1998

[54] ENGAGEMENT DETECTION CONNECTOR

[75] Inventor: Takeshi Tsuji, Yokkaichi, Japan

[73] Assignee: Sumitomo Wiring Systems, Ltd., Japan

[21] Appl. No.: 659,762

[22] Filed: Jun. 6, 1996

[30] Foreign Application Priority Data

Jun. 29, 1995 [JP] Japan ..... 7-188454

[51] Int. Cl.[6] ..... H01R 3/00

[52] U.S. Cl. ..... 439/489

[58] Field of Search ..... 439/188, 488, 439/489, 350, 357

[56] References Cited

U.S. PATENT DOCUMENTS 4,900,267 2/1990 Nagasaka et al. .

5,061,204 10/1991 Murakami ..... 439/489

FOREIGN PATENT DOCUMENTS 2-50982 4/1990 Japan .

*Primary Examiner*—P. Austin Bradley

*Assistant Examiner*—Yong Ki Kim

*Attorney, Agent, or Firm*—Anthony J. Casella; Gerald E. Hespos; Ludomir A. Budzyn

[57] ABSTRACT

The invention is designed to detect an incomplete engagement of a connector at an earlier stage. A female connector 10 is formed with a locking arm 13, and a male connector 20 is formed with an engaging groove 23. A short-circuiting fitting 41 is mounted in the lower portion of the locking arm 13, and detection terminals 42 are inserted below the locking arm 13. Accordingly, as the locking arm 13 is deformed at an intermediate stage of an engaging operation, the short-circuiting fitting 41 is moved downward, thereby electrically connecting the detection terminals 42. When engaging projection 13*c* formed on the locking arm 13 pops into the engaging groove 23, thereby fully engaging the connectors 10 and 20, the detection terminals 42 are electrically disconnected. In other words, by being notified of the intermediate stage of the engaging operation, an operator can determine the completion of the engaging operation earlier.

13 Claims, 7 Drawing Sheets

ENGAGEMENT DETECTION CONNECTOR

BACKGROUND OF THE INVENTION

1. Field of the Invention

The present invention relates to an engagement detection connector capable of detecting its engaged state.

2. Description of the Prior Art

A prior art engagement detection connector is disclosed in Japanese Unexamined Utility Model Publication No. 2-50982, and an essential portion of this connector is shown in FIG. 7.

In FIG. 7, a pair of engagement detecting terminals 2 are arranged side by side in one connector housing 1 so as to project toward a mating connector housing 3. The mating connector housing 3 is provided with a short-circuiting fitting 4 including two arms 4*a* arranged in conformity with the detecting terminals 2, and a short-circuiting portion 4*b* connecting the two arms 4*a*. In the connector housing 1, slanted guide faces 5 are formed in positions corresponding to the arms 4*a*.

As the connector housings 1 and 3 are moved closer to each other to be engaged, the arms 4*a* move upward along the guide faces 5. When the connector housings 1 and 3 are fully engaged, the arms 4*a* leave the guide faces 5 and are brought into pressing contact with the detecting terminals 2, thereby establishing an electrical connection between the detecting terminals 2.

In the above prior art connector, the engaged state cannot be detected after completion of the engaging operation and, accordingly, a discrimination as to whether the engaging operation has been fully performed can be made only at a late stage.

In view of the above problem, it is an object of the present invention to provide an engagement detection connector capable of detecting an incomplete engagement at an earlier stage.

SUMMARY OF THE INVENTION

According to the invention there is provided an engagement detection connector comprising: a first connector, a second connector engageable with the first connector, and an intermediate state detecting means detecting an intermediate state of engagement during the engagement process of the first connector and the second connector.

According to a preferred embodiment the first connector comprises an elastic means which is deflected by engaging a deflecting means provided on the second connector, and wherein the intermediate state detecting means comprises a deflection detection means for detecting the deflection or deformation of the elastic means, wherein the elastic means preferably comprises a wedge-shaped engaging projection which engages the deflecting means thus deflecting the elastic means.

Preferably, the intermediate state detecting means comprises a short-circuiting means creating or interrupting a short-circuit of the deflection detection means in the intermediate state of engagement of the first connector and the second connector.

Further preferably, the short-circuiting means is provided on the elastic means.

According to a further preferred embodiment, an electrical state of the deflection detection means, in particular an electrical connection state of detection terminals of the deflection detection means, varies when terminals accommodated in the first and second connectors are electrically connected.

Preferably, the deflecting means provided on the second connector comprises an engaging groove into which the elastic means can project after it was deflected during the engagement process of the first and second connectors.

Further preferably, the deflecting means has a frame-shaped configuration, wherein the elastic means most preferably comprises locking means interacting with the deflecting means.

According to a further preferred embodiment the engagement detection connector further comprises: full engagement detection terminals for detecting whether the connector is fully engaged, and determination means for making a determination in accordance with a combination of detection results of the deflection detection means and the full engagement detection terminals.

According to a preferred embodiment of the invention there is provided an engagement detection connector capable of detecting its intermediate state during engagement.

Accordingly, during the engaging operation, a change from the unengaged state to the partly engaged state is detected, but a change from the partly engaged state to the fully engaged state is not detected.

Generally, an operator can easily see whether the connector is unengaged or not. Accordingly, there is no problem even if the unengaged state of the connector is not detected. On the other hand, the partly engaged state of the connector can be detected if an alarm sound is given during an intermediate stage of the engaging operation. Then, the operator can easily know that the engaging operation is completed when the alarm sound stops. On the other hand, if a detection is made after the connector is fully engaged as in the prior art connector, an alarm sound is given upon completion of the engaging operation. In this case, the operator needs to stop the alarm sound.

As described above, there can be provided the engagement detection connector capable of notifying the intermediate stage of the engaging operation before it is completed, consequently capable of notifying the completion of the engaging operation and enabling an earlier determination as to whether the engaging operation has been completed or not.

The engagement detection connector according to claim 2 can be easily embodied by adopting the generally used locking arm.

Further, according to claim 3, a spring force of the locking arm can be increased by the repulsive force of the detection terminals. On the other hand, in the connector in which the detection terminals are deformed to be electrically connected when the connector is fully engaged, the detection terminals remain deformed while the connector is fully engaged. Accordingly, the detection terminals may be subject to plastic deformation, with the result that they may be unable to maintain an electrical connection. On the contrary, the deforming movement of the locking arm lasts for a very short period. If the detection terminals are so arranged as to be deformable at the same time the locking arm is deformed, they are electrically connected for the very short period during the engaging operation. When the connector is fully engaged, the detection terminals recover their configuration, thereby losing an electrical connection therebetween. As a result, the detection terminals are not subject to plastic deformation.

Preferably, the engagement detection connector comprises an elastic locking arm being engageable after its deforming movement and recovering movement, and detection terminals for detecting the deformation of the locking arm. Accordingly, the elastic locking arm engages after its deforming and recovering movements, and the detection terminals detect the deformation of the locking arm.

Further preferably, the detection terminals detects the deforming movement of the locking arm by being pressed as the locking arm is deformed in the above engagement detection connector.

Accordingly, the detection terminals are pressed as the locking arm is deformed, thereby changing their electrical connection state. As a result, the deforming movement of the locking arm can be detected. Since the detection terminals are pressed during the deforming movement of the locking arm, a repulsive force acts.

Thus, a spring force of the locking arm can be increased by the repulsive force of the detection terminals. On the other hand, in the connector in which the detection terminals are deformed to be electrically connected when the connector is fully engaged, the detection terminals remain deformed while the connector is fully engaged. Accordingly, the detection terminals may be subject to plastic deformation, with the result that they may be unable to maintain an electrical connection. On the contrary, the deforming movement of the locking arm lasts for a very short period. If the detection terminals are so arranged as to be deformable at the same time the locking arm is deformed, they are electrically connected for the very short period during the engaging operation. When the connector is fully engaged, the detection terminals recover their configuration, thereby losing an electrical connection therebetween. As a result, the detection terminals are not subject to plastic deformation.

Further preferably, the electrical connection state of the detection terminals varies when terminals accommodated in the connector are electrically connected in the above engagement detection connector.

Accordingly, by arranging the detection terminals in specified positions, their electrical connection state changes when the terminals accommodated in the connector are electrically connected. In other words, the electrical connection state of the detection terminals varies even during the engaging operation depending upon whether the terminals are electrically connected or not.

Thus, at least a normal state as a circuit can be detected at an earliest stage. The terminals can be electrically connected even at an intermediate stage of the engaging operation. In a state in which the terminals are electrically connected, but the connectors are not lockingly engaged, a circuit may be properly closed. In this state, the connectors are easily disengageable if necessary. Accordingly, a circuit check may be conducted at the intermediate stage of the engaging operation before the connectors are lockingly engaged. There are some cases where the connector may be engaged only to the extent that a circuit is closed. The above connector can be suitably used in such cases.

According to a further preferred embodiment, the engagement detection connector further comprises a full engagement detection terminals for detecting whether the connector is fully engaged, and determination means for making a determination in accordance with a combination of detection results of the detection terminals and the full engagement detection terminals.

Accordingly, the full engagement detection terminals detect whether the connector is fully engaged, and the determination means makes a determination in accordance with a combination of the detection results of the detection terminals and the full engagement detection terminals. Normally, the engaged state of the connector varies from the unengaged state to the fully engaged state through the partly engaged state. The proper engagement of the connector can be determined if the detection results follow the above pattern. If the pattern of the detection results is different, an abnormal engaging operation or a defect of the detection terminals can be determined. For example, if the engaged state of the connector can be detected based on the electrical connection state of the detection terminals, four different states can be detected by two pairs of detection terminals. The determination can be made by following the pattern of the states. If a detection can be simply made as to whether the connector is fully engaged or not, the full engagement may be detected even if the terminals are electrically connected due to a short circuit. However, if the pattern of the states is checked, an erroneous engaging operation and a defective terminals can also be detected.

Thus, not only the partly engaged state is detected to notify the progress of the engaging operation, but also the completion of the engaging operation and a normally indeterminable defect of the terminals can be determined by following the variation of the engaged states.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Figure 1:
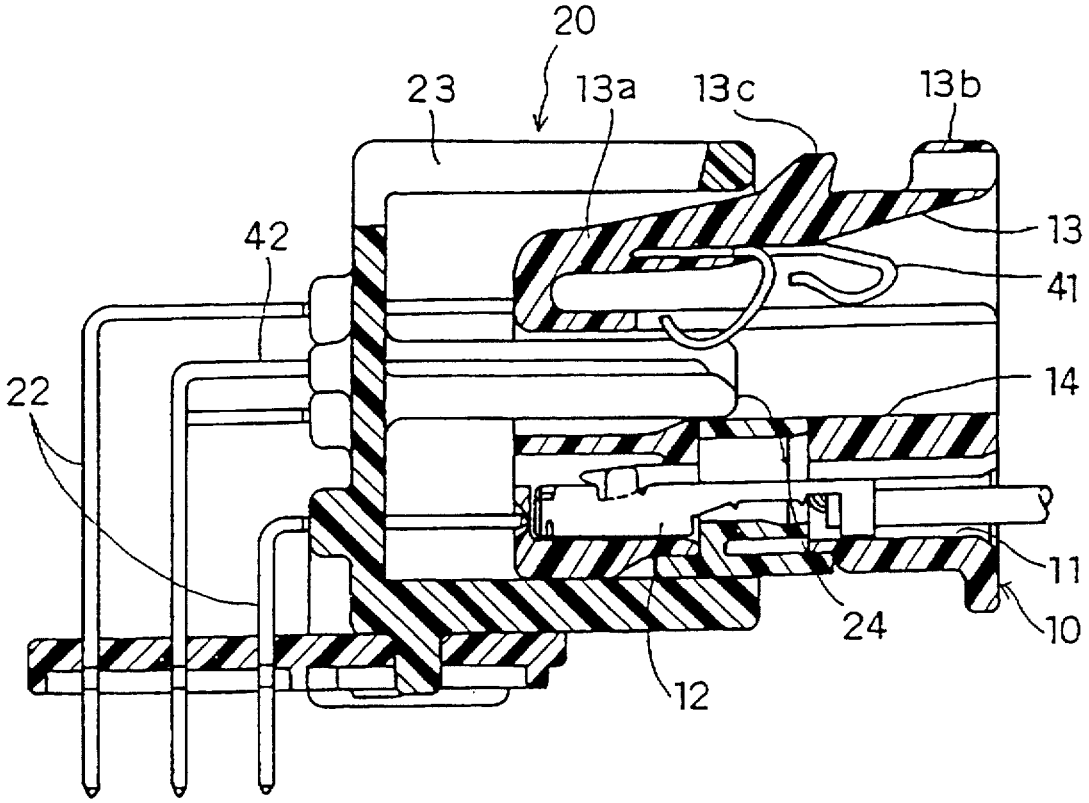
FIG. 1 is a section of an engagement detection connector according to one embodiment of the invention when the engaging operation of female and male connectors is started.

In FIG. 1, a female connector 10 has a substantially boxlike outer shape and is formed with a plurality of terminal cavities 11. A male connector 20 is in the shape of a bottomed hollow cylinder into which the female connector 10 is insertable. Female terminal fittings 12 are accommodated in the terminal cavities 11 of the female connector 10. When the female connector 10 is inserted into the male connector 20, male terminal fittings 22 mounted through the back wall of the male connector 20 are inserted into the female terminal fittings 12 in the terminal cavities 11 through a front opening of the female connector 20, thereby establishing an electrical connection. The male terminal fittings 22 are bent downward behind the back wall of the male connector 20. The male connector 20 is connected with or mounted on a circuit board and the leading ends of the male terminal fittings 22 are inserted through holes formed in the circuit board and fixed therein by soldering.

Although the male connector 20 is of the type to be fixed on the board and the female connector 10 is inserted into the fixed male connector 20 in this embodiment, the connectors are not particularly limited to these. The invention is applicable to general connectors which are engaged with each other. The connector of this embodiment is engaged by inserting the box-shaped female connector 10 into the male connector 20 equipped with the bottom, but the engaging mode of the connector is not particularly limited to that.

An engaging groove 23 is formed in the widthwise center of the ceiling wall of the male connector 20. The engaging groove 23 is closed at the opening edge of the ceiling wall. In the widthwise center of the upper surface of the female connector 10, a locking arm 13 is formed in a position corresponding to the engaging groove 23. The locking arm 13 includes an arm 13*a* which projects upward from the front end of the upper surface of the female connector 10 and is bent backward, and a projection 13*b* which is formed at the rear end of the upper surface of the arm 13*a* and is handleable by finger. There is also formed a substantially wedge-shaped engaging projection 13*c* in a portion of the arm 13*a* contiguous with the projection 13*b*. The engaging projection 13*c* is engageable with the closed end of the engaging groove 23.

In this embodiment, as the female connector 10 is inserted into the male connector 20, the locking arm 13 is deformed downward by engagement of the engaging projection 13*c* with the closed end of the engaging groove 23 formed in the ceiling wall of the male connector 20. The locking arm 13 recovers its configuration after the engaging projection 13*c* moves beyond the closed end of the engaging groove 23. The locking arm 13 does not necessarily engage the male connector 20 from inside. For example, the locking arm 13 may move beyond an engaging projection formed on the outer surface of the male connector 20, or may have any other construction such as a seesaw-like construction.

Figure 2:
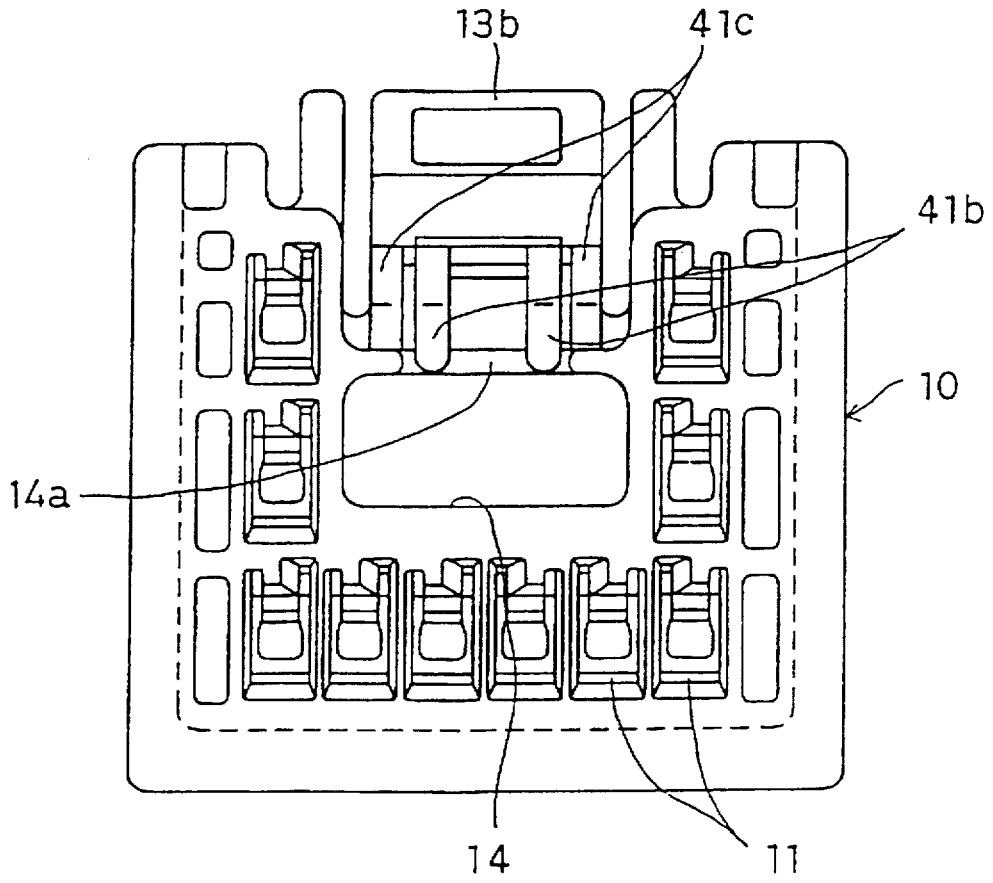
FIG. 2 is a rear view of the female connector of the engagement detection connector.

In the center of the female connector 10, there is formed, as shown in FIG. 2, a through hole 14 which extends over or through the female connector 10 in a longitudinal direction. Only a front portion of the ceiling wall of the through hole 14 is left, and the arm 13*a* of the locking arm 13 projects therefrom. An opening 14*a* is formed from the middle to the rear end of the ceiling wall of the through hole 14, and the lower surface of the arm 13*a* of the locking arm 13 faces the through hole 14 through the opening 14*a*.

Figure 3:
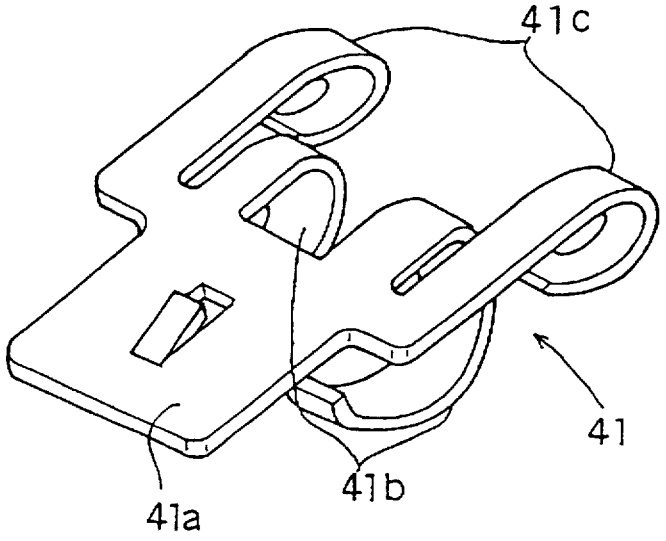
FIG. 3 is a perspective view of a short-circuiting fitting 3.
Figure 4:
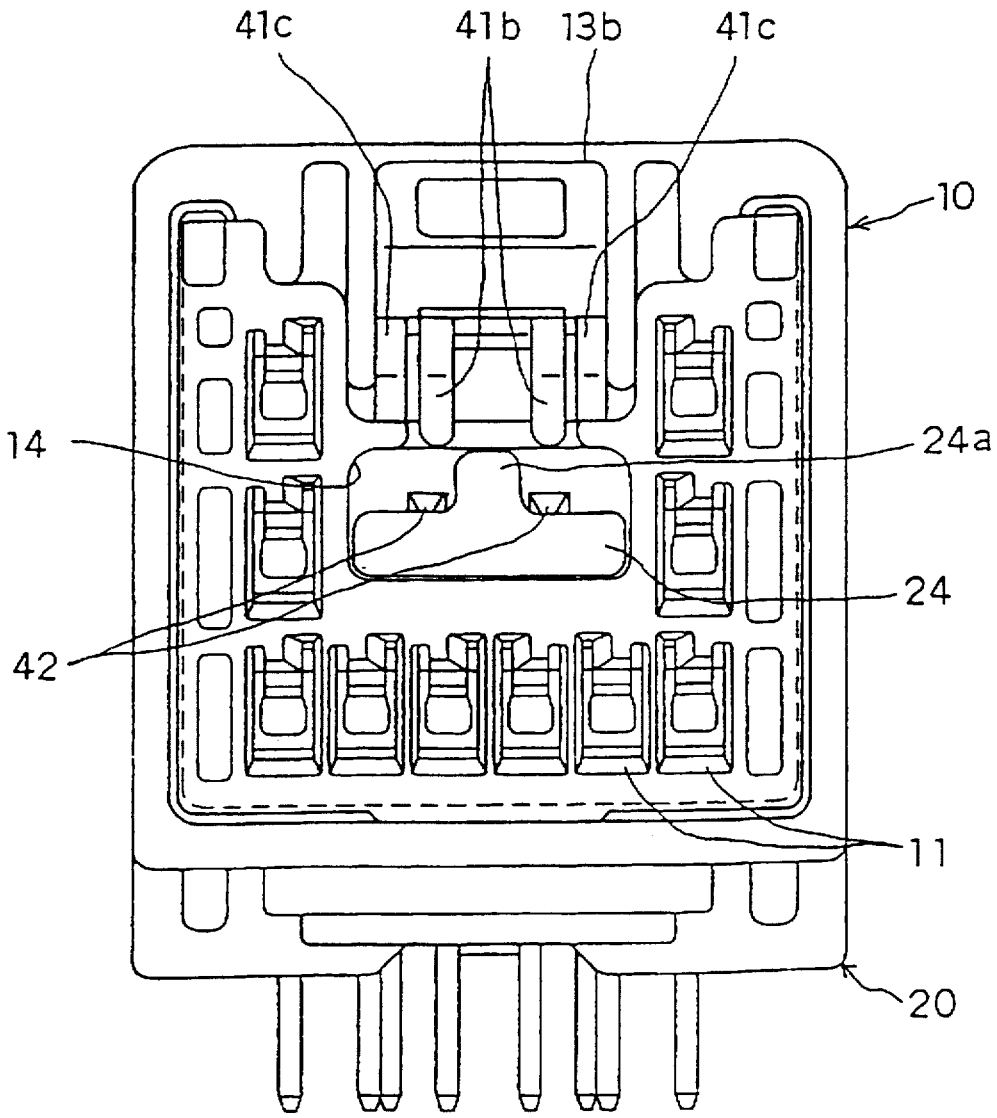
FIG. 4 is a rear view of the engagement detection connector when the female and male connectors are engaged.

A short-circuiting fitting 41 of metal shown in FIGS. 1 and 3 is mounted in the lower portion of the arm 13*a*. The short-circuiting fitting 41 includes a flat base porion 41*a*, terminal portions 41*b*, and spring portions 41*c*. The base portion 41*a* is pressed into and fixed in the lower front part of the arm 13*a*. The terminal portions 41*b* extend straight backward in parallel with the extension of the through hole 14 from the rear end of the base portion 41*a* and are triangularly curved in their intermediate positions so as to project downward. The spring portions 41*c* extend straight backward from the opposite sides of the rear end of the base portion 41*a* and are triangularly curved in their intermediate positions so as to project downward and face remaining portions of the ceiling wall of the through hole 14 on the opposite sides of the opening 14*a*.

On the other hand, there is formed, on the back wall of the male connector 20, a projected portion 24 which is insertable into the through hole 14 as the connectors 10 and 20 are engaged. The projected portion 24 is formed into a flat plate extending substantially in the horizontal direction, and a projection 24*a* is formed in the widthwise middle of the upper surface of the projected portion 24 so as to divide the upper surface into the left and right portions. The projection 24*a* is formed in such a position that it is inserted between the terminal portions 41*b* of the short-circuiting fitting 41 mounted in the locking arm 13 as the projected portion 24 is inserted into the through hole 14. Accordingly, the terminal portions 41*b* face the left and right portions of the upper surface of the projected portion 24. Detection terminals 42 extending in the forward/backward direction through the back wall of the male connector 20 are placed on the left and right portions of the upper surface of the projected portion 24. Similar to the other male terminal fittings 22, the detection terminals 42 are bent downward behind the back wall of the male connector 20.

The detection terminals 42 face the terminal portions 41*b* of the short-circuiting fitting 41. When the locking arm 13 is deformed downward so that the engaging projection 13*c* thereof moves over the closed end of the engaging groove 23, the short-circuiting fitting 41 is also moved downward, thereby bringing the terminal portions 41*b* into contact with the detection terminals 42 through the opening 14*a*. The locking arm 13 is gradually deformed as the female connector 10 is inserted into the male connector 20, and the terminal portions 41*b* are connected with the detection terminals 42 when the female terminal fittings 12 are connected with the male terminal fittings 22.

In this embodiment, the short-circuiting fitting 41 is mounted in the lower portion of the locking arm 13 of the female connector 10; the detection terminals 42 are inserted below the short-circuiting fitting 41 from the male connector 20; and the short-circuiting fitting 41 is pressed against the detection terminals 42 by the downward deformation of the locking arm 13 at an intermediate stage of the engaging operation. However, the short-circuiting fitting 41 may not necessarily be mounted in the locking arm 13 so long as an electrical connection state of the detection terminals 42 varies while the connectors are being engaged.

For example, the detection terminals 42 may have a crank-like shape, i.e. may be bent in the vertical direction, and the short-circuiting fitting 41 held in the female connector 10 may be horizontally movable. Then, during the engaging operation of the connectors, the short-circuiting fitting 41 comes into sliding contact with the leading ends of the detection terminals 42, thereby establishing an electrical connection. When the connectors are fully engaged, the fitting 41 reaches the bent portions of the detection terminals 42, thereby departing from the detection terminals 42. If the short-circuiting fitting 41 is movable upon deformation of the locking arm 13 as in the foregoing embodiment, a force for pressing the short-circuiting fitting 41 acts only at the intermediate stage of the engaging operation. Since this force does not act after the connectors are fully engaged, even after lapse of a long period, the short-circuiting fitting 41 will not be plastically deformed and be able to make a precise detection.

The detection terminals 42 are not necessarily electrically connected at the intermediate stage of the engaging operation. They may be electrically disconnected at that stage. The engaged state may be detected in any other possible fashion, e.g. by a variation of a resistance value. In this embodiment, the short-circuiting fitting 41 acts to establish an electrical connection between the detection terminals 42 when the female terminal fittings 12 and the male terminal fittings 22 are connected. The electrical connection state between the detection terminals 42 may be changed at any timing at the intermediate stage of the engaging operation. If the timing is set as in this embodiment, it is at least known upon determining the partly engaged state that the mating terminal fittings are electrically connected, thereby enabling an earlier start of an electrical connection check.

Further, although the detection is made by a combination of the short-circuiting fitting 41 and a pair of detection terminals 42 in this embodiment, it is sufficient that the electrical connection state of the detection terminals 42 vary at the intermediate stage of the engaging operation. For example, the leading ends of the detection terminals 42 may be placed one over the other so that they temporarily come apart or are connected during the insertion of the female connector 10. This arrangement also enables a similar detection.

Next, the operation of the thus constructed embodiment is described.

When the female and male connectors 10 and 20 are not engaged, the detection terminals disposed in the male connector 20 are separately placed on the upper surface of the projected portion 24 and thus there is no electrical connection therebetween.

As the female connector 10 is inserted into the male connector 20, the slanted face of the engaging projection 13*c* formed on the arm 13*a* of the locking arm 13 comes into contact with the opening edge of the male connector 20 and is deformed downward so as to allow a further insertion. As the arm 13*a* is deformed downward, the short-circuiting fitting 41 moves downward and the spring portions 41*c* are pressed against the portions of the ceiling wall of the female connector 10 on the opposite sides of through hole 14, thereby being compressed. Accordingly, the spring portions 41*c* act to intensify the resilient or repulsive force of the locking arm 13. As the locking arm 13 is deformed while the spring portions 41*c* are compressed, the terminal portions 41*b* enter the through hole 14 through the opening 14*a*.

Figure 5:
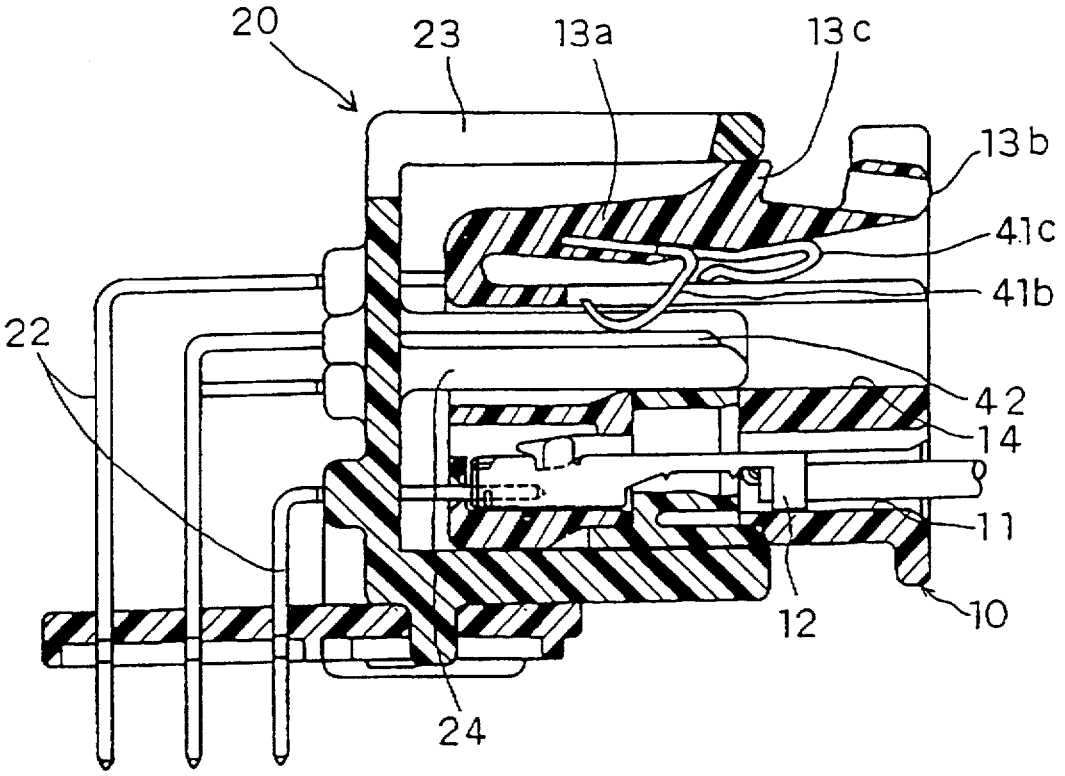
FIG. 5 is a section of the engagement detection connector at an intermediate stage of the engaging operation.

When the female terminal fittings 12 are connected with the male terminal fittings 22 as the female connector 10 is further inserted into the male connector 20 as shown in FIG. 5, the locking arm 13 is deformed by a larger degree, in particular by virtue of the wedge-shaped engaging projection 13*c* interacting with the front end of the engaging groove 23, with the result that the terminal portions 41*b* are brought into contact with the detection terminals 42, thereby establishing an electrical connection therebetween. At this stage, if the detection terminals 42 are formed, for example, by an alarm switch, an alarm sound is given to inform the intermediate stage of the engaging operation. On the other hand, a circuit check or the like may be started since the female and male terminal fittings are electrically connected.

Figure 6:
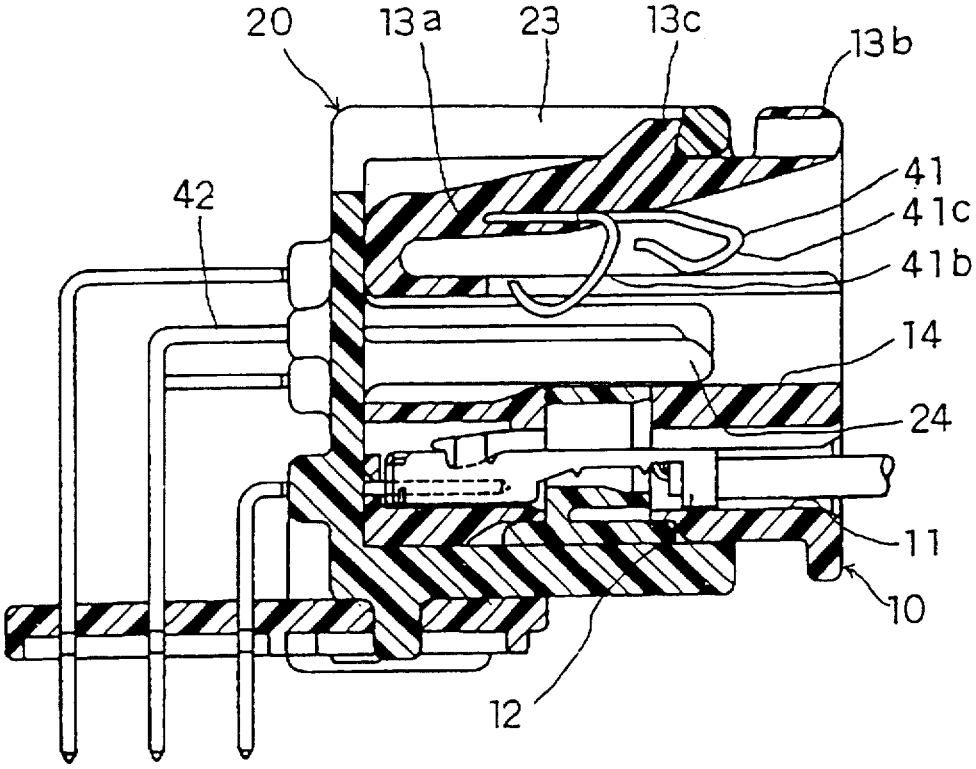
FIG. 6 is a section of the engagement detection connector when the female and male connectors are completely engaged.
Figure 7:
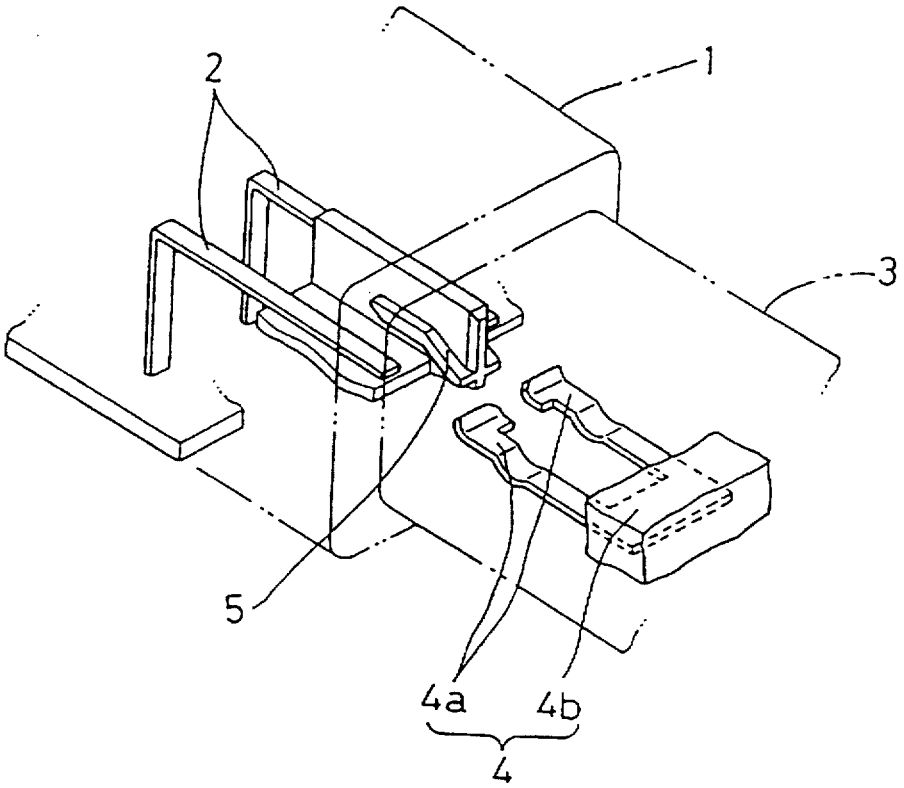
FIG. 7 PRIOR ART
FIG. 7 is a schematic perspective view of an essential portion of a prior art engagement detection connector.

When the female connector 10 is fully inserted into the male connector 20 as shown in FIG. 6, the engaging projection 13*c* of the locking arm 13 pops into the engaging groove 23, and the locking arm 13 recovers its configuration. Since the short-circuiting fitting 41 also moves upward to its original position, the terminal portions 41*b* are disengaged from the detection terminals 42, thereby electrically disconnecting the detection terminals 42. In the case that an alarm sound is given at the intermediate stage of the engaging operation, the alarm sound stops and the operator can confirm that the connectors are fully engaged.

As described above, the female connector 10 is formed with the locking arm 13; the male connector 20 is formed with the engaging groove 23; the short-circuiting fitting 41 is mounted in the lower portion of the locking arm 13; and the detection terminals 42 are inserted below the locking arm 13. Accordingly, as the locking arm 13 is deformed at the intermediate stage of the engaging operation, the short-circuiting fitting 41 is moved downward, thereby electrically connecting the detection terminals 42. When the engaging projection 13*c* of the locking arm 13 pops in the engaging groove 23 and the connectors 10 and 20 are fully engaged, the detection terminals 42 are electrically disconnected. In other words, by being notified of the intermediate stage of the engaging operation, the operator can determine the completion of the engaging operation earlier.

Although the engaged state is detected only by the detection terminals 42 and the short-circuiting fitting 41 in this embodiment, full engagement detection terminals for detecting the full engagement of the connectors as in the prior art may be arranged beside the detection terminals. If the full engagement detection terminals have terminal portions which are electrically connected with each other when the connectors are fully engaged, neither the detection terminals 42 nor the full engagement detection terminals are electrically connected before the normal engaging operation; the detection terminals 42 are electrically connected upon start of the engaging operation; the detection terminals 42 are electrically disconnected and the full engagement detection terminals are electrically connected upon completion of the engaging operation. The connected state of these detection terminals are as follows:

| ENGAGED STATE | BEFORE ENGAGE-MENT | DURING ENGAGE-MENT | AFTER ENGAGE-MENT |
|---|---|---|---|
| DETECTION TERMINALS 42 | NEC | EC | NEC |
| FULL ENGAGEMENT DETECTION TERMINALS | NEC | NEC | EC |

(where NEC = not electrically connected, EC = electrically connected)

A determination as to whether or not the engaging operation has been properly performed can be made by detecting a variation of the electrical connection state. For example, the full engagement detection terminals may be electrically connected just because they are short-circuited, or it is not clear when the electrical connection state of the full engagement detection terminals should be detected. However, the engaging operation is determined to have been properly performed if the state of the full engagement detection terminals changes from the non-electrical connection state to the electrically connected within a specified period after the detection terminals 42 are brought into an electrical connection. On the other hand, if the detection terminals 42 are short-circuited, they are electrically connected regardless of the engaging operation. Accordingly, the connected state of the full engagement detection terminals does not vary during the engaging operation, and an occurrence of abnormality cannot be brought to the operator's attention.

According to the above description, when the locking arm 13 is deformed during the engagement of the female connector 10, the short-circuiting fitting 41 comes into contact with the detection terminal 42 of the male connector 20. At this stage the incomplete engagement detection is performed by detecting whether a circuit formed by the detection terminal 42, the terminal portion 41*b*, the further terminal portion 41*b* and the further detection terminal 42 is short-circuited or connected or alternatively open or not connected. In other words, the short circuit detection according to the above description is made based on the connection state of the detection terminals 42 and the terminal portions 41*b*, i.e. if the detection terminals 42 and the terminal portions 41*b* are forming a connected loop or not. Alternatively, the incomplete engagement detection may be performed based on a connection state of a circuit, wherein the terminal portion 41*b* or the fitting 41 may be grounded via a wiring harness. The incomplete engagement detection is then performed by detecting by means of a circuit detector whether the circuit is grounded or not grounded (open).

What is claimed is:

1. An engagement detection connector comprising:

a first connector (10) comprising an elastic member (13), a second connector (20) configured for movement relative to the first connector (10) from an unengaged state, through an intermediate state where portions of said first connector (10) and said second connector (20) are in movable contact with one another and into a fully engaged state, the second connector 20 comprising a deflecting member (23) disposed for deflecting the elastic member (13) when the first connector (10) and the second connector (20) are in the intermediate state, and an intermediate state detector (41, 42) for detecting the intermediate state of engagement of the first connector (10) and the second connector (20), the intermediate state detector (41, 42) comprising a deflection detector (42) for detecting the deflection of the elastic means (13) and a short-circuiting means (41) for affecting a short-circuit of the deflection detector (42) in the intermediate state of the first connector (10) and the second connector (20).

2. An engagement detection connector according to claim 1, wherein the elastic member (13) comprises a wedge-shaped engaging projection (13*c*) disposed for engaging the deflecting member (23) and deflecting the elastic member (13) when the first connector (10) and the second connector (20) are moved through the intermediate state and toward the engaged state.

3. An engagement detection connector according to claim 1, wherein the short-circuiting means (41) is provided on the elastic means (13).

4. An engagement detection connector according to claim 1, wherein the first connector (10) and the second connector (20) each comprise at least one terminal fitting (12, 22), said terminal fittings (12, 22) being electrically connected to one another when said first connector (10) and said second connector (20) are in said intermediate state and when said first connector (10) and said second connector (20) are in said engaged state, the deflection detector (42) comprising a plurality of detection terminals (42), an electrical connection state of the detection terminals (42) varying when the terminal fittings (12, 22) accommodated in the first and second connectors (10, 20) become electrically connected.

5. An engagement detection connector according to claim 1, wherein the deflecting member (23) provided on the second connector (20) comprises an engaging groove (23) into which the elastic member (13) can project after the first and second connectors (10, 20) are in the engaged state.

6. An engagement detection connector according to claim 1, wherein the deflecting member (23) has a frame-shaped configuration.

7. An engagement detection connector according to claim 1, wherein the elastic member (13) comprises locking means interacting with the deflecting member (23) for releasably locking the first and second connectors (10, 20) in the engaged state.

8. An engagement detection connector according to claim 1, further comprising:

full engagement detection terminals (4; 5) for detecting whether the connector is in the engaged state, and determination means for making a determination in accordance with a combination of detection results of the deflection detection means (42) and the full engagement detection terminals (4;5).

9. An engagement detection connector comprising:

a first connector (10), a second connector (20) configured for movement relative to the first connector (10) from an unengaged state, through an intermediate state where portions of said first connector (10) and said second connector (20) are in movable contact with one another and into a fully engaged state, and an intermediate state detector (41, 42) for detecting the intermediate state of engagement of the first connector (10) and the second connector (20), the intermediate state detector (41, 42) comprises means for affecting a short-circuit when said first and second connectors (10, 20) are in the intermediate state.

10. An engagement detection connector comprising:

a first connector (10), a second connector (20) configured for movement relative to the first connector (10) from an unengaged state, through an intermediate state where portions of said first connector (10) and said second connector (20) are in movable contact with one another and into a fully engaged state, and an intermediate state detector (41, 42) for detecting the intermediate state of engagement of the first connector (10) and the second connector (20), said intermediate state detector (41, 42) comprises a plurality of detection terminals (42) in a selected one of said first and second connectors (10, 20) and a short-circuiting fitting (41) in the other of said first and second connectors (10, 20), said short-circuiting fitting (41) being disposed for engaging said detection terminals (42) when said first and second connectors (10, 20) are in said intermediate state, said short-circuiting fitting (41) further being disposed in spaced relationship to said detection terminals (42) when said first and second connectors (10, 20) are in said engaged state.

11. An engagement detection connector according to claim 10, wherein the first connector (10) comprises an elastic member (13) and wherein the second connector (20) comprises a deflecting member (23) disposed for deflecting the elastic member (13) when said first and second connectors (10, 20) are in said intermediate state, the short-circuiting fitting (41) being disposed on said elastic member (13) and being deflectable into engagement with said detection terminals (42) in response to said deflection of said elastic member (13).

12. An engagement detection connector according to claim 11, wherein the first and second connectors (10, 20) comprise locking means for releasably locking said first and second connectors (10, 20) together in said engaged state.

13. An engagement detection connector according to claim 12, wherein at least a portion of said locking means is disposed on said elastic member (13).

* * * * *